US005626491A

United States Patent [19]

Hasircoglu

[11] Patent Number: 5,626,491

[45] Date of Patent: May 6, 1997

[54] ELECTRICAL CONNECTOR STRAIN RELIEF FOR CABLE

[75] Inventor: Alexander W. Hasircoglu, Columbia, Pa.

[73] Assignee: The Whitaker Corporation, Wilmington, Del.

[21] Appl. No.: 516,706

[22] Filed: Aug. 18, 1995

[51] Int. Cl.[6] ..... H01R 13/58

[52] U.S. Cl. ..... 439/459

[58] Field of Search ..... 439/456, 459, 439/460, 470

[56] References Cited

U.S. PATENT DOCUMENTS

| | | | |
|---|---|---|---|
| 3,989,336 | 11/1976 | Rizzio, Jr. et al. | 339/74 R |
| 3,997,234 | 12/1976 | Worman | 339/105 |
| 4,108,527 | 8/1978 | Douty et al. | 339/107 |
| 4,367,005 | 1/1983 | Douty et al. | 339/107 |
| 4,430,523 | 2/1984 | Hayes | 174/135 |
| 4,432,592 | 2/1984 | Boutros et al. | 439/460 |
| 4,444,450 | 4/1984 | Huber | 339/107 |
| 4,734,056 | 3/1988 | Bertini et al. | 439/460 |
| 4,749,370 | 6/1988 | Moser et al. | 439/460 |
| 4,804,342 | 2/1989 | Rudy, Jr. et al. | 439/467 |
| 4,902,236 | 2/1990 | Hasircoglu | 439/77 |
| 5,059,134 | 10/1991 | Schauer et al. | 439/164 |
| 5,059,138 | 10/1991 | Olsson | 439/460 |
| 5,100,342 | 3/1992 | Olsson | 439/497 |
| 5,108,306 | 4/1992 | Wellinsky | 439/404 |

FOREIGN PATENT DOCUMENTS

| | | | |
|---|---|---|---|
| 0056184A1 | 7/1982 | European Pat. Off. . | |
| 2607702 | 9/1977 | Germany | 439/456 |
| 1021989 | 3/1966 | United Kingdom . | |
| 8001339 | 6/1980 | WIPO | 439/460 |

OTHER PUBLICATIONS

IBM Technical Disclosure Bulletin, "Strain Relief for Insulation Displacement Connector", vol. 32, No. 6A, p. 337. 439/460 Nov. 1989.

*Primary Examiner*—Gary F. Paumen
*Attorney, Agent, or Firm*—Anton P. Ness

[57] ABSTRACT

A strain relief for ribbon cable (12) or discrete cables (82.84) in a connector (10). Strain relief insert (32) provides a recess (34) having a narrow entrance (36) into which is urged a fold (44) of cable (12) while the insert portions (42) are temporarily flexed or pivoted apart, or the fold is insertable from an end of the recess; a retention rod (46) is inserted into the fold above the cable from the side, such that a cable loop (50) extends around the rod at bend (44). The assembly is then urged into a shell pocket (24) adjacent the cable exit (20), with the pocket sidewalls (52) preventing the insert portions (42) from spreading apart at the narrow entrance after assembly. Strain from the cable (12.82.84) onto the connector tends to urge the cable loop (50) and rod (46) against the constriction of the narrow recess entrance (36) but they are trapped in the recess. A self-sustaining strain relief member (92) may be secured to a connector at its cable exit.

14 Claims, 7 Drawing Sheets

ELECTRICAL CONNECTOR STRAIN RELIEF FOR CABLE

FIELD OF THE INVENTION

The present invention relates to electrical connectors and more particularly to connectors for electrical cable and strain relief of the cable.

BACKGROUND OF THE INVENTION

For electrical connectors utilized to terminate ends of electrical cables, it is of particular importance for the connector assembly housing the individual terminals to be firmly physically affixed to the cable to relieve the terminations of the individual conductors of the cable to the respective terminals, when strain is applied on the connector by the cable. There are many various approaches to strain relief, some of which apply a strain relief device to both the connector and the cable, and some of which provide for the connector to include a design generating inherent strain relief upon being applied to the cable. One particular strain relief approach is disclosed in U.S. Pat. No. 3,997,234 in which a plurality of discrete conductor wires extend through a first slot of a rearward planar member, around bars and through a second slot prior to terminated ends thereof being housed in the connector, with partial loops of the wires around the bars formed to extend transverse to the axes of the wires, and with the bars of the planar member serving to absorb strain as the loops of the wires tend to be urged back into the wire axes upon strain being applied thereto. In U.S. Pat. No. 5,059,134 is disclosed a pair of complementary inserts in rearward cavities of a connection housing, with one of the inserts having an embossment urging portions of the bare wire ends just rearward of the terminated ends, into a receiving recess of the other insert, thus clamping the wires by deforming portions thereof out of the plane of the wire axes.

It is desired to provide a strain relief system that is internal to the connector and that does not rely on clamping of the cable or wire or otherwise compressing the insulative covering thereof.

It is further desired to provide a strain relief that may be utilized with flat ribbon cable as well as discrete conductor wires.

SUMMARY OF THE INVENTION

The strain relief of the present invention is provided by the connector assembly directly on a ribbon cable or pair of ribbon cables, or to a row of discrete conductor wire, or to a row of coaxial cables or twisted pair cable, at the cable exit. Generally a recess is defined into a cable-proximate surface of the body of the connector adjacent the rearward end, with the recess extending in a direction perpendicular to the plane of the cable or wire array and having a narrow entrance along the cable-proximate surface. The cable or cables are manipulated to form a loop that is urged into the narrow entrance of the recess, and thereafter a retention rod is inserted through the loop from one side. The rod need only have a diameter large enough to be prevented from passing through the narrow entrance considering that two thickness of cable already are positioned in the entrance.

In one embodiment, two connector shell halves are fastened to each other to coextend along a portion of the cable rearwardly from the terminations of the cable's conductors to the terminals secured within the dielectric housing of the connector. A pocket is formed into at least one of the shells at the cable exit, and an insert is provided that is receivable into the pocket after the insert is first affixed to the cable. A recess of the insert is defined having a narrow entrance into which a fold of the cable is inserted, preferably with the insert being flexible or pivotable about a hinge at the center of the insert surface to be adjacent the bottom of the recess, to temporarily enable enlargement of the narrow entrance, such that the fold of the cable is disposed in a substantial undercut of the recess after which a rod is inserted into the inside of the fold with a diameter large enough after the cable is looped around the rod to exceed the width of the entrance.

After the insert is urged into the shell pocket, the insert is held rigidly to prevent flexing, thus trapping the fold of cable in the insert recess with the rod through the cable loop. The insert may also comprise two halves that when urged together about the cable loop with the rod in place and placed into the shell pocket, are rigidly held together by the shell. Any strain placed on the cable will tend to attempt pulling the cable loop and the rod contained in the loop out of the insert recess, but presence of the rod will prevent withdrawal through the narrower entrance, defining an effective strain relief. Strain is transmitted to the thicknesses of cable portions between the rod and the portions of the insert defining the narrow entrance. Both shells may have such pockets and inserts thus enabling termination of a pair of such cables, which may have round conductors or flat conductors.

In another embodiment, a separate subassembly may be fastened to the rear face of the connector, wherein a member of relatively nonresilient material defines the closed-ended loop-receiving recess adjacent a narrow entrance, and at least one of the closed ends of the member includes a hole in communication with the recess. After insertion of a loop of a cable or plurality of wires into the recess, a retention rod is inserted through the hole and through the cable or wire loop.

It is an objective of the present invention to provide an effective strain relief for a cable connector.

It is additionally an objective to provide a strain relief especially suitable for use with ribbon cable, as well as being suitable for use with discrete conductor wires, or twisted pair cable or coaxial cable, or even a mixture of two or more types thereof.

Embodiments of the invention will now be described by way of example with reference to the accompanying drawings.

DETAILED DESCRIPTION OF THE PREFERRED EMBODIMENTS

Figure 1:
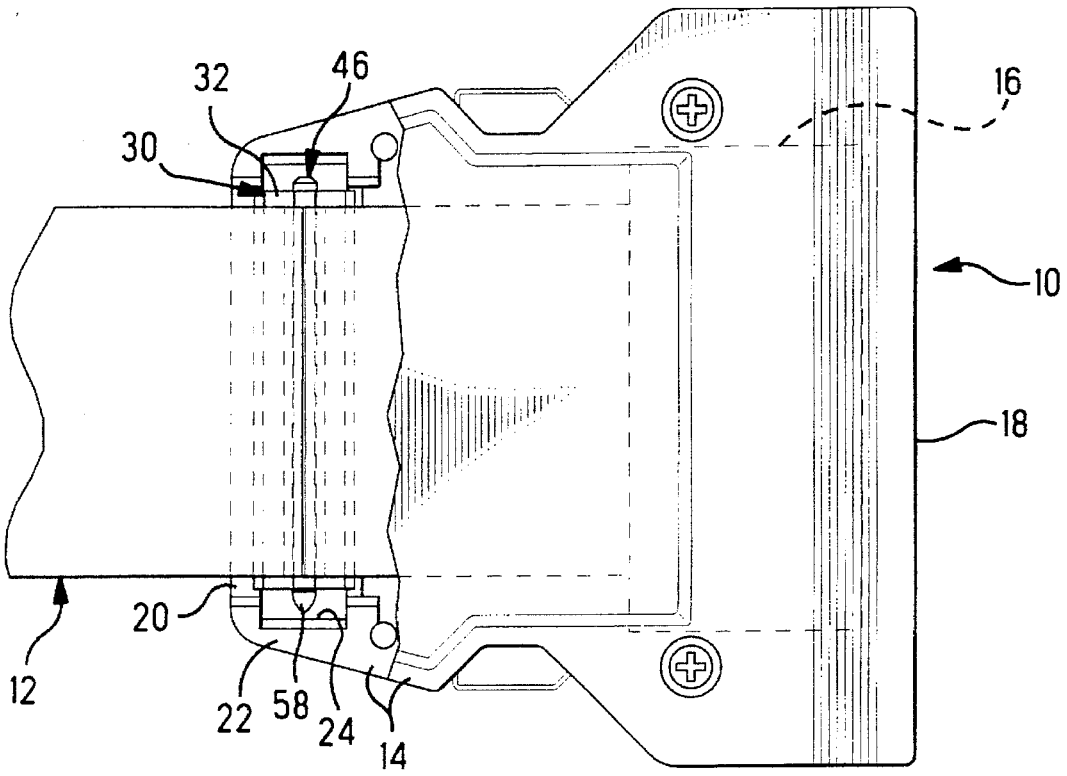
FIG. 1 is a plan view of a connector terminated to a ribbon cable, with the rearward shell portion broken away to expose the strain relief of the present invention.
Figure 2:
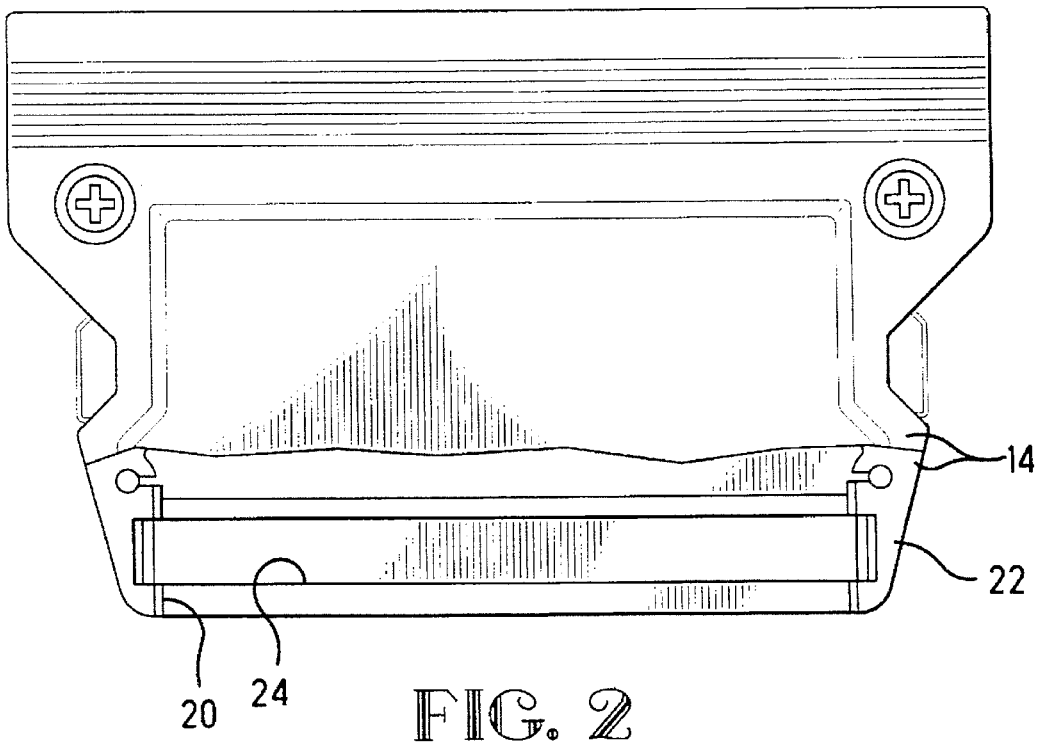
FIG. 2 is a plan view of the shell assembly of the connector of FIG. 1 with a rearward portion broken away to expose the pocket.
Figure 3:
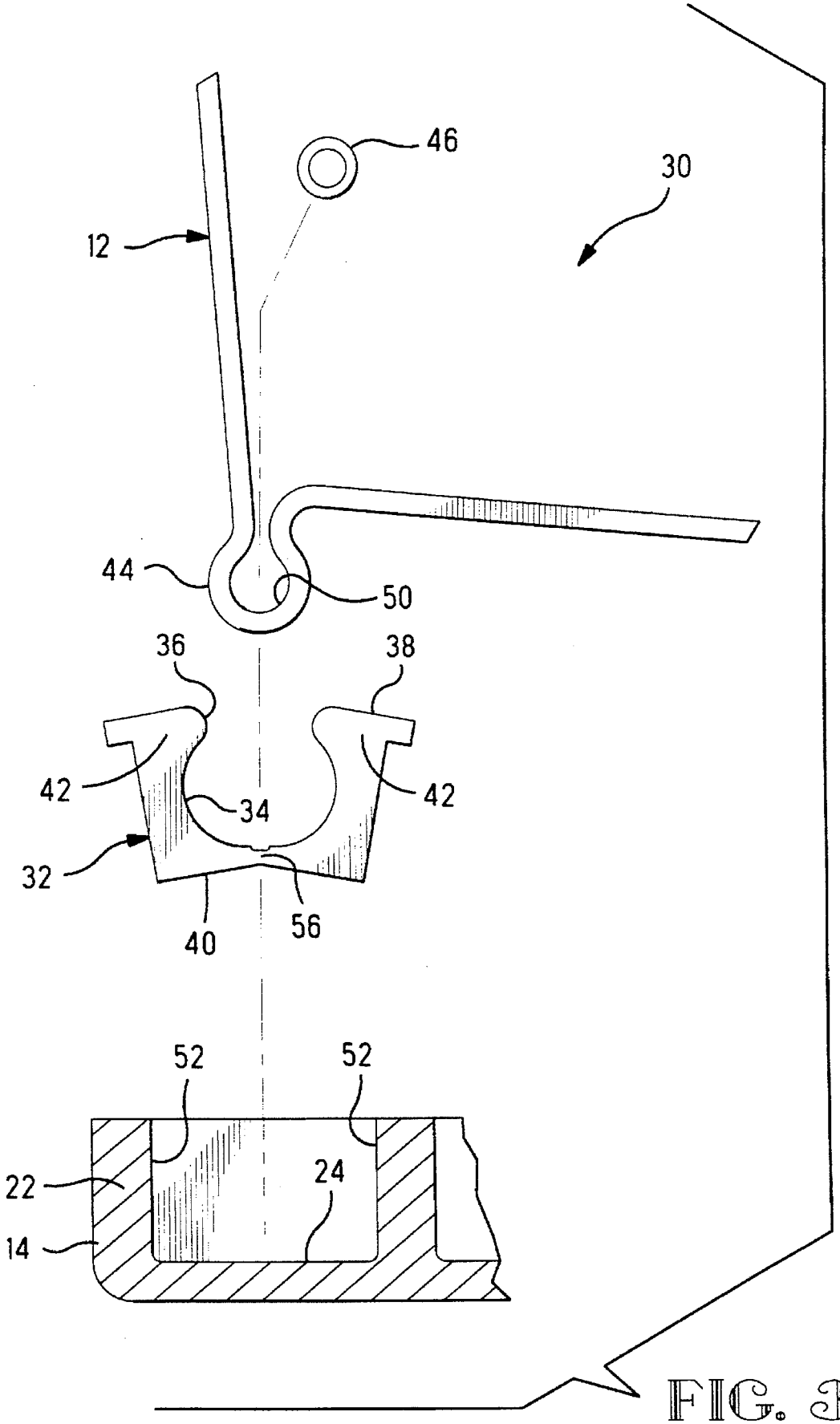
FIG. 3 is a diagrammatic representation of the strain relief assembly, with an insert and associated rod exploded from the shell pocket to be assembled to a cable portion.
Figure 4:
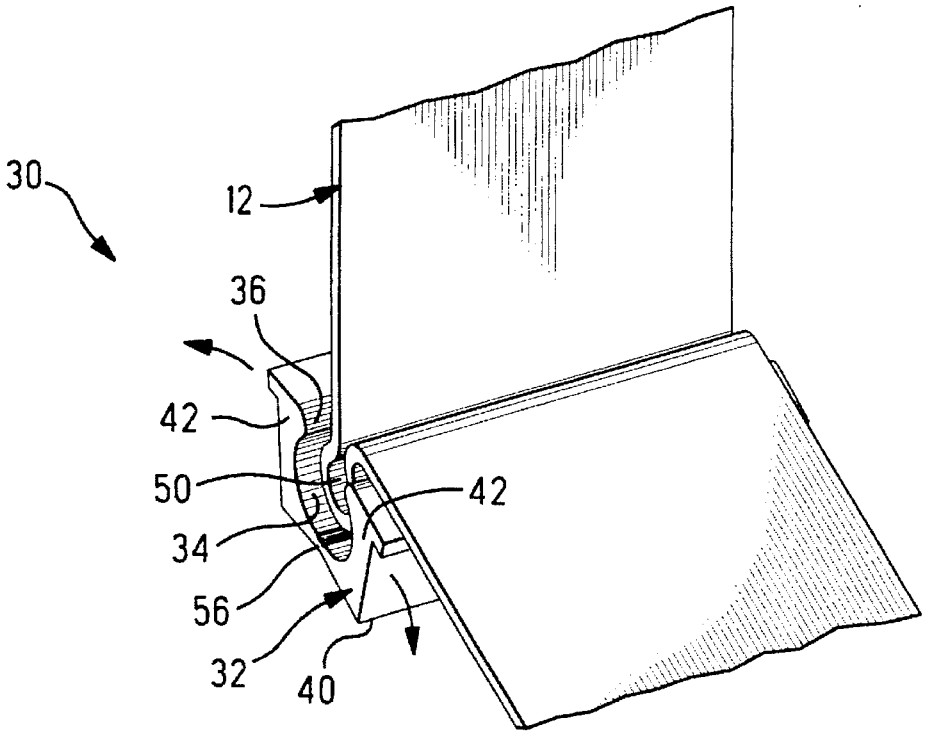
FIGS. 4 to 6 are isometric views of the strain relief, with FIG. 4 showing the cable folded and inserted into the insert recess, FIG. 5 showing the rod being inserted into the cable loop within the recess, and FIG. 6 showing the strain relief assembly within the shell pocket.
Figure 5:
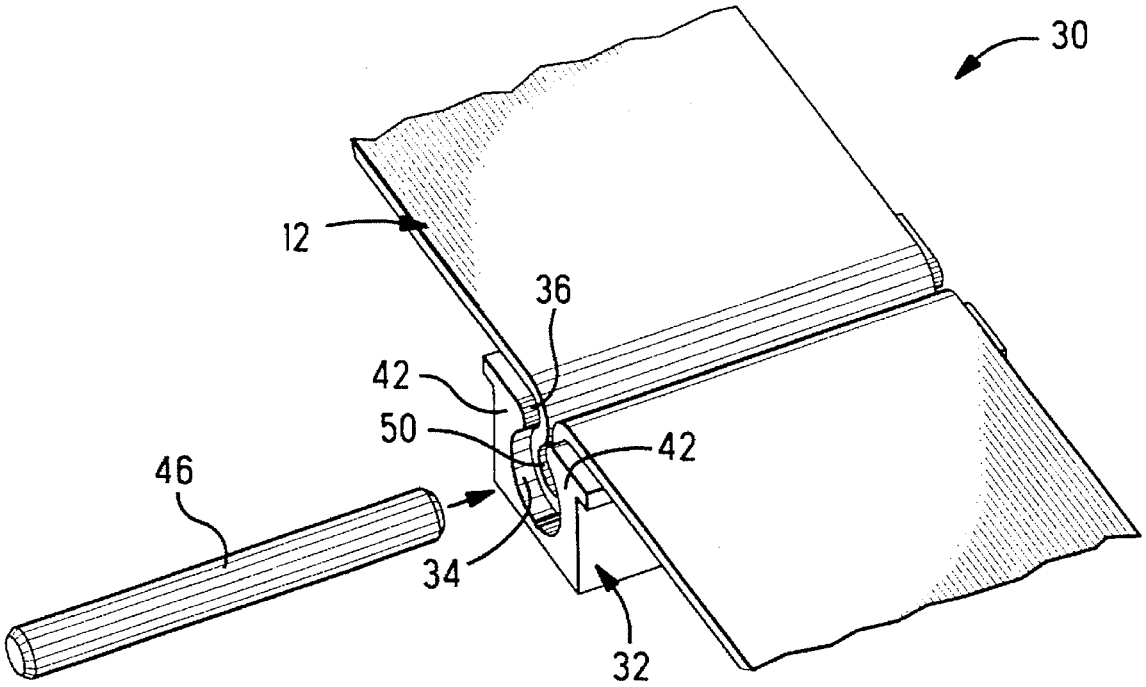
Figure 6:
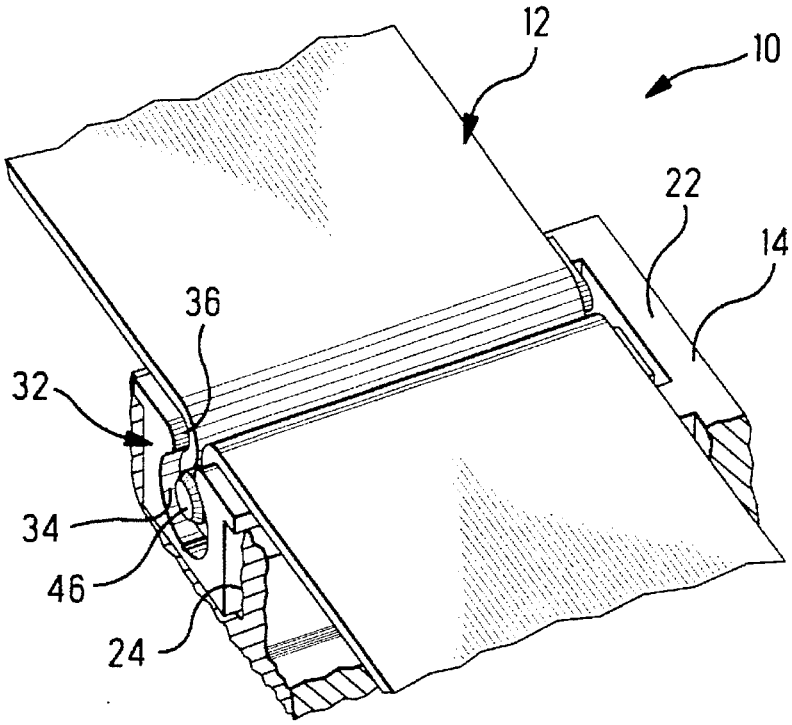

Referring to FIGS. 1 to 6, the strain relief of the present invention is especially for use with a connector 10 for ribbon cable 12, where the connector includes a pair of protective shells 14 within which the connector housing 16 is disposed along mating face 18 opposed from cable exit 20. Rearward shell end 22 is provided with a pocket 24 adjacent cable exit 20, wherein the strain relief assembly 30 is insertable. Strain relief assembly 30 includes an insert 32 having a recess 34 having an entrance 36 along an assembly face 38, opposed from a shell-proximate face 40. Insert 32, if it is an integral member, is flexible or pivotable about an axis along the shell-proximate face 40 so that opposed portions 42 may be temporarily urged apart at entrance 36 to permit insertion into recess 34 of a fold 44 of cable 12. A rod 46 is then inserted from a side 48 of the insert to be disposed in a loop 50 of the cable formed at the fold 44. The strain relief assembly is then placed into shell pocket 24, where the rigid pocket side walls 52 hold the insert portions 42 firmly to prevent flexing or pivoting apart.

Figure 8:
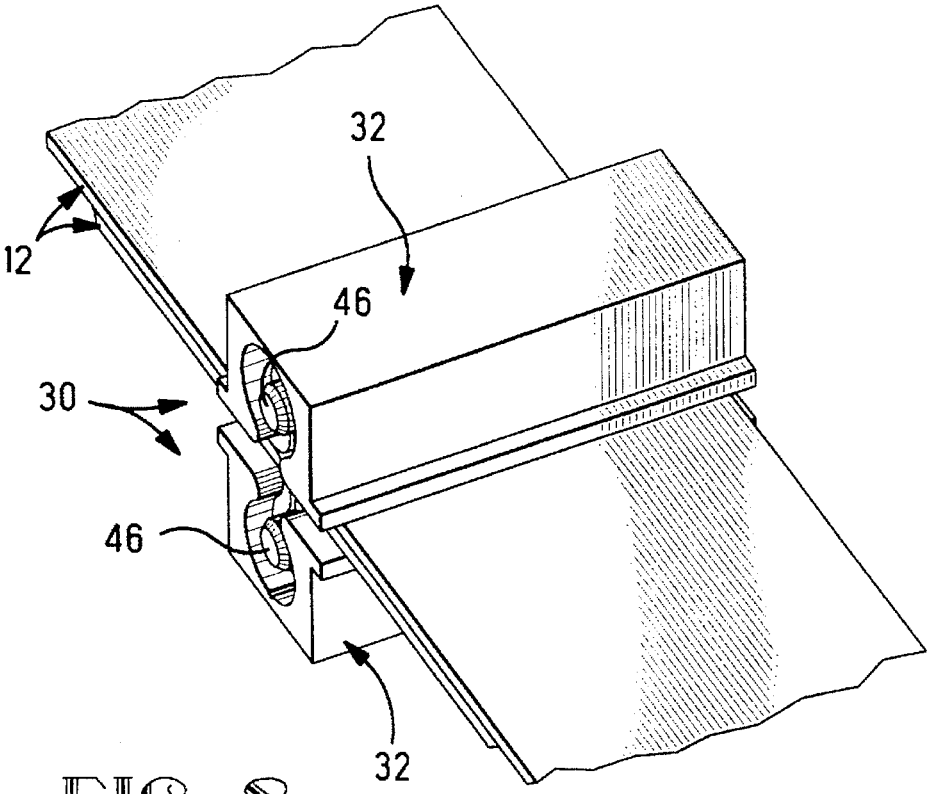
FIGS. 8 and 9 are similar to FIGS. 6 and 7 and show a pair of strain relief assemblies for a pair of ribbon cables for insertion into opposed shell pockets.
Figure 7:
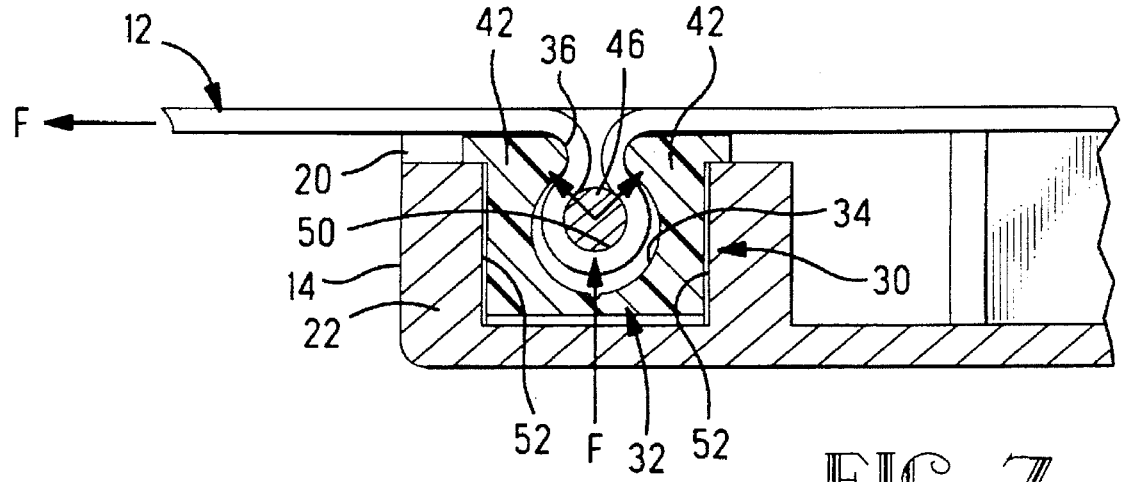
FIG. 7 is an enlarged cross-section of the strain relief assembly within a connector shell.
Figure 9:
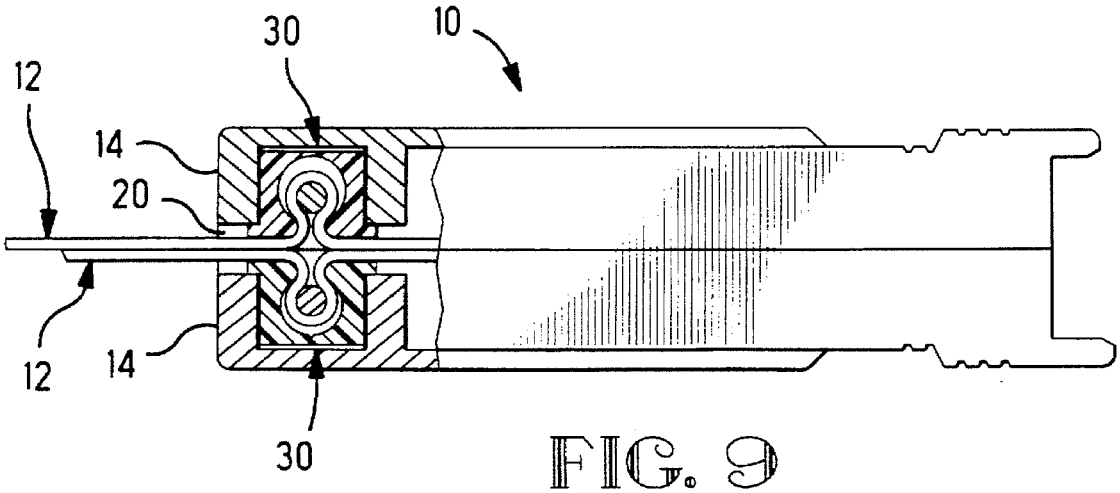

Upon complete connector assembly, and referring to FIG. 7, strain F exerted onto the connector by cable 12 will tend to pull cable loop 50 toward narrow entrance 36. The presence of rod 46 within cable loop 50 will not permit the cable loop to be withdrawn from insert recess 34, and instead will transmit the strain F to the undercut areas 54 of insert portions 42 and also tend to compress the thickness of cable 12 between rod 46 and undercut areas 54. FIGS. 8 and 9 together illustrate connector 10 terminated onto a pair of superposed ribbon cables 12 each utilized with a strain relief assembly of the present invention. Narrow entrance 36 need only be as wide as two thicknesses or diameters of the cable with which it is to be used. Recess 34 may have a wide range of dimensions or diameters to accommodate the cable bend and retention rod. Retention rod 46 has a diameter larger than the difference between the dimension of the narrow opening 36 less two cable thicknesses, but should be sufficiently larger to overcome reduced thicknesses or diameters of the cable insulative material from compression under strain as well as any compression of the insert material and the retention rod itself under strain.

Figure 10:
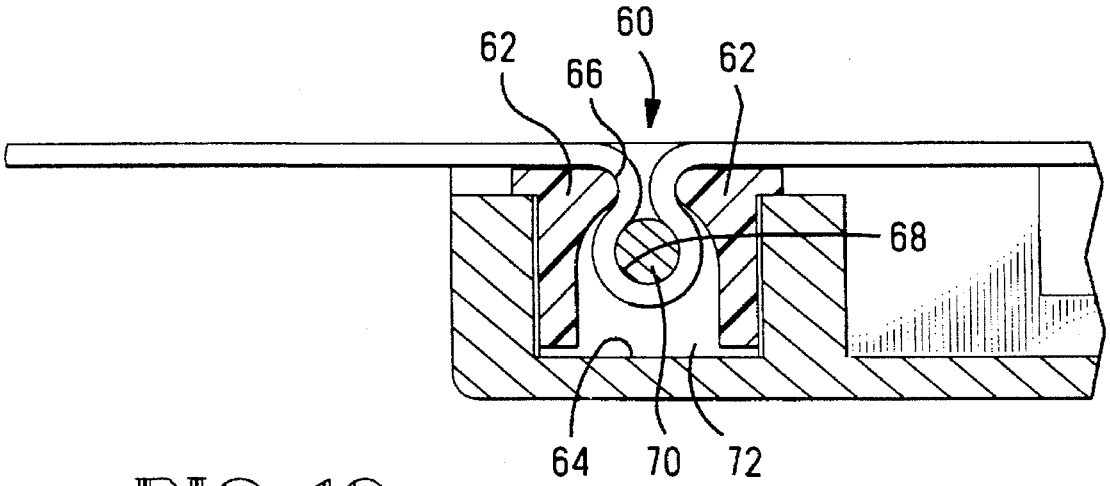
FIG. 10 is a cross-section view of an alternate embodiment of strain relief insert.

Preferably insert 32 is an integral member molded of plastic material such as nylon, with a living hinge 56 defined at the center of the recess bottom to permit flexing or pivoting of the opposed insert portions 42 during cable fold insertion. Rod may also be a plastic member such as of nylon or hard rubber with only limited resilience, but may also be metal. Rod 46 may have a forward end 58 frustoconical in shape as seen in FIG. 1 to facilitate initial entry into cable loop 50. With reference to FIG. 10, the strain relief 60 of the present invention could include separate members 62 that when deposited into shell pocket 64 are prevented from being urged apart at narrow entrance 66, thus effectively trapping a cable loop 68 and associated rod 70 within the recess 72 defined between the separate members 62. If desired, such separate members could be clipped together to facilitate handling prior to insertion into shell pocket 64.

Figure 11:
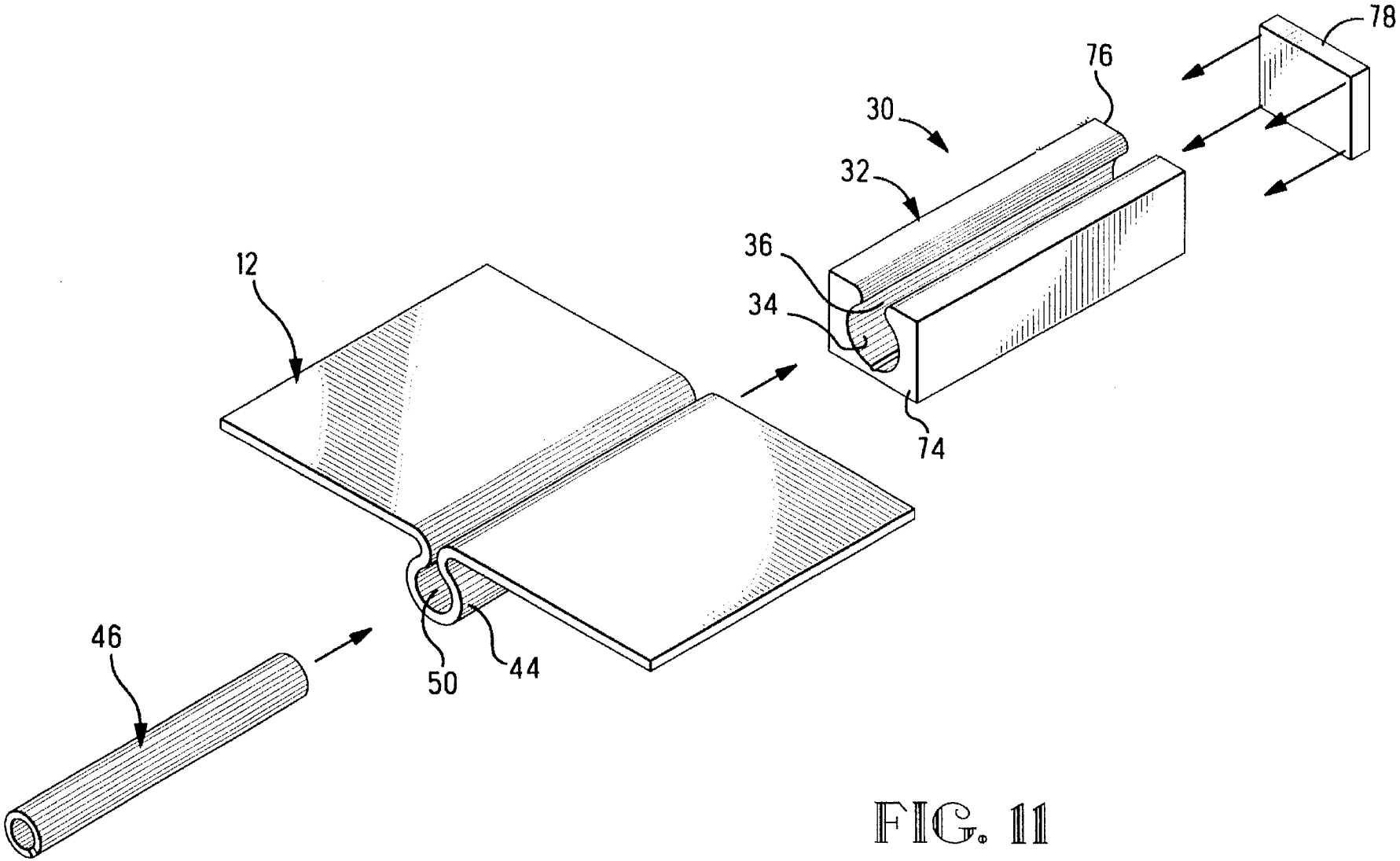
FIG. 11 is an isometric view illustrating an alternate manner of placing a loop of cable into the strain relief of FIGS. 1 to 9.

In FIG. 11 is seen an alternate manner of placing the cable into the insert, wherein a loop 50 of cable 12 is formed at bend 44, whereafter the cable bend 44 is inserted laterally into one end 74 of strain relief insert 32 to be positioned within recess 34. The two continuous portions of cable 12 extend through narrow entrance 36, and retention rod 46 is now insertable into loop 50 to complete the assembly. An end wall 78, if desired, may be secured to insert 32 to close off the other end 76 of recess 34, such as by bonding or ultrasonic welding.

Figure 12:
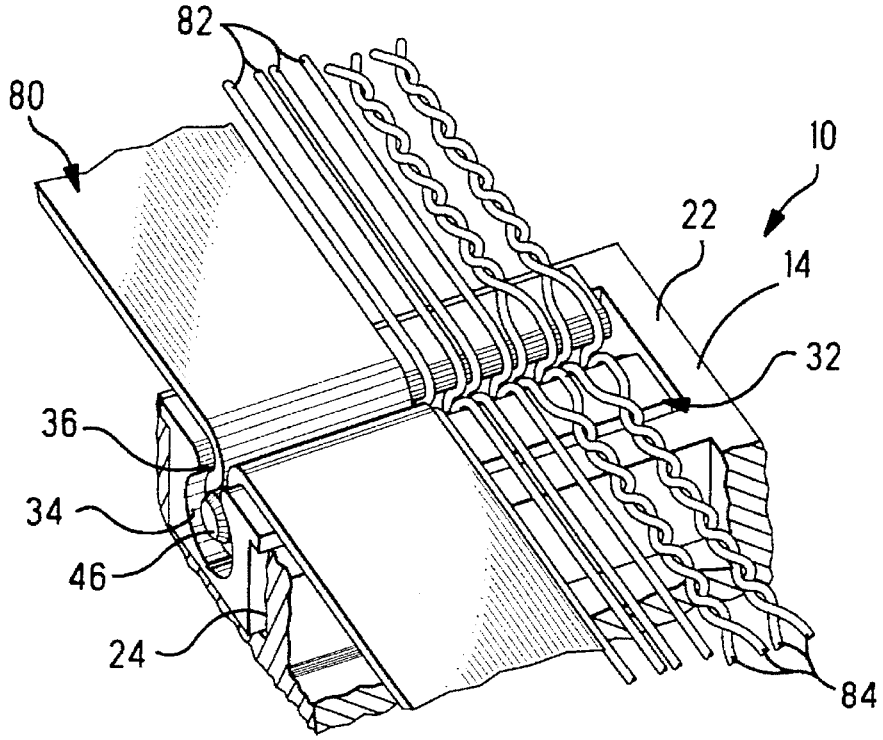
FIG. 12 is an isometric view illustrating a plurality of discrete cables utilizing the strain relief of the present invention.

FIG. 12 illustrates that the strain relief of the present invention may be utilized, not only with flat cable or ribbon cable, but also with one or more discrete conductor wires 82 that may be coaxial cables, and even with twisted pair cable 84. A hybrid of cable may be used in the same strain relief, such as ribbon cable 80, discrete wires 82 and twisted pair 84 where the different cables may carry signal transmission, including coaxial, as well as power and even ground. Where discrete cable is used, it may be preferred to utilize a retention rod having some resilience, especially where the cables have differing diameters or thicknesses, and distributing the strain more evenly across the insert. The rod may even be compressible to facilitate strain distribution so long as its diameter even when compressed remains larger than any opening between the two cable portions extending through the narrow entrance when under strain.

Figure 13:
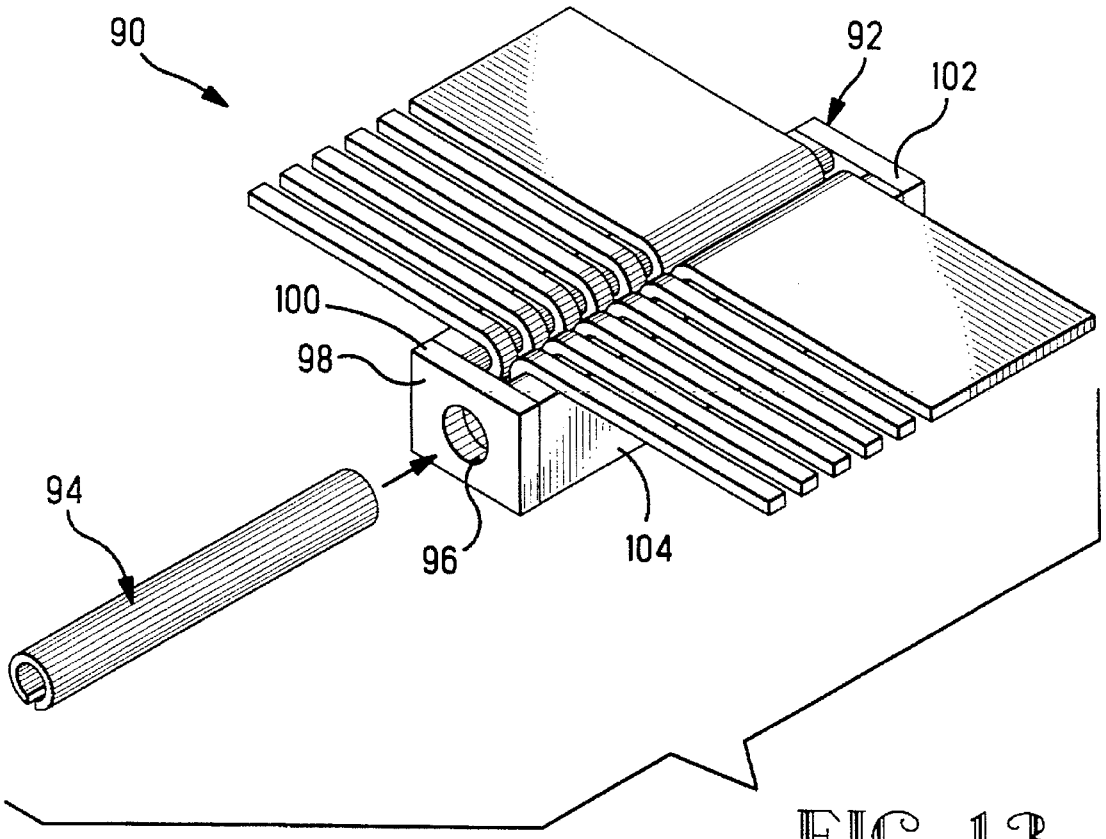
FIG. 13 is an alternate embodiment of strain relief member having closed ends, one with an opening for retention rod insertion, and defining a self-sustaining strain relief.

FIG. 13 shows an alternate embodiment of strain relief 90 of the present invention, wherein member 92 preferably would be made of rigid, durable material such as metal or hard plastic requiring no surrounding rigid walls of the connector as in FIGS. 1 to 12 to maintain the narrow dimension of the narrow entrance. This embodiment could be utilized outside the connector proper and be attached by conventional means to the rearward end of the connector, such as with clips or latches (not shown). Retention rod 94 could be for example a roll pin and be insertable through a slightly smaller diameter rod-receiving hole 96 in end face 98 of member 92 with roll pin being reduced in diameter during insertion and reexpanding upon full insertion, since it is preferred that the ends of the recess be closed. End walls of member 92 can be defined such as by end caps 100,102 affixed to ends of a central member 104 such as by bonding or ultrasonic welding if plastic material is used, or by welding or soldering if metal is used, or even by use of force-fitting embossments into smaller diameter bores (not shown) between the end caps and the ends of central member 104. End cap 102 may be completely closed, or may have an opening such as 96 in end cap 100, permitting tool insertion to urge roll pin 94 outwardly if disassembly is desired, with an interior end of opening 96 being enlarged (not shown) to receive the roll pin end to initiate entry into opening 96 when being urged outwardly.

Other variations and modifications may be made that are within the spirit of the invention and the scope of the claims.

What is claimed is:

1. A strain relief for an electrical connector terminatable onto an end of electrical cable, comprising:

a block at least affixable to a cable exit portion of an electrical connector and having a cable-proximate surface extending along said electrical cable axially and transversely;

a recess into said block having a narrow entrance extending through and transversely across said cable-proximate surface, said narrow entrance having a dimension in the axial direction at least equal to twice the thickness of said cable and said recess having a dimension in the axial direction greater than said narrow entrance dimension; and a retention rod insertable into said recess to extend transversely across the cable width and having a diameter greater than the difference between said narrow entrance dimension and two times the thickness of said cable, and said block being adapted to permit receipt of said retention rod into said recess, whereby a loop of said cable is insertable into said recess with portions of said cable on either side of the loop positioned in the narrow entrance, and the retention rod is insertable substantially through said loop from side to side, and upon complete assembly of the connector said loop of cable is retained in said recess by the retention rod when the cable is subjected to strain.

2. The strain relief of claim 1 wherein said block is an integral member.

3. The strain relief of claim 1 wherein end caps are affixed to ends of said block to at least substantially close off ends of said recess.

4. The strain relief of claim 1 wherein said block includes a pair of cooperating halves defining said recess therebetween.

5. The strain relief of claim 1 wherein said block includes end walls at least one of which includes a rod-receiving hole therethrough in communication with said recess.

6. The strain relief of claim 5 wherein said retention rod is a roll pin, and said rod-receiving hole is slightly smaller in diameter than said roll pin.

7. The strain relief of claim 1 wherein said recess includes a closed recess bottom.

8. The strain relief of claim 1 wherein said block is insertable into a pocket of a shell member of said connector adjacent said cable exit and traversing the cable path.

9. A strain relief for an electrical connector terminatable onto an end of an electrical cable, comprising:

a pair of shell members together containing the housing and securable to each other in a manner extending along an end portion of said cable rearwardly to a cable exit;

at least one said shell member being of rigid material and containing an insert-receiving pocket adjacent said cable exit along a cable-proximate inner surface of said one shell member;

an insert insertable into said insert-receiving pocket, said insert including a recess extending from a narrow cable-receiving entrance to a recess bottom, with the insert adapted to permit said narrow cable-receiving entrance to temporarily be widened prior to placement of said insert into said shell pocket; and a retention rod adapted to be inserted into said insert recess, all such that a loop of cable is insertable into said recess through said narrow cable-receiving entrance and said rod insertable through said cable loop, whereby, after placement of said insert into said insert-receiving pocket with said cable loop and retention rod therewithin, and fastening together said pair of shell members about said cable end portion, walls of said insert-receiving pocket trap said cable loop and retention rod within said insert recess defining an effective strain relief.

10. The strain relief of claim 9 wherein said insert is a unitary member of resilient material flexible at said recess bottom to permit widening of said narrow cable-receiving entrance to permit cable loop insertion.

11. The strain relief of claim 9 wherein said insert comprises a pair of members separable from each other to permit widening of said narrow cable-receiving entrance.

12. The strain relief of claim 9 wherein both said shell members include insert-receiving pockets thereinto into which respective said inserts are insertable for defining strain relief for a pair of said cables.

13. The strain relief of claim 9 wherein said retention rod is of cylindrical shape having a diameter greater than said narrow cable-receiving entrance when said insert is held within said insert-receiving pocket.

14. The strain relief of claim 9 wherein said retention rod includes a frustoconical forward end facilitating initial insertion into said cable loop.

* * * * *